United States Patent [19]

Luchonok

[11] Patent Number: 5,075,913

[45] Date of Patent: Dec. 31, 1991

[54] WATER MATTRESS WITH DUAL DENIER FIBER BAFFLE

[75] Inventor: Jeffrey J. Luchonok, Redondo Beach, Calif.

[73] Assignee: Advanced Sleep Products, Carson, Calif.

[21] Appl. No.: 711,906

[22] Filed: Jun. 7, 1991

[51] Int. Cl.[5] ..... A47C 27/08

[52] U.S. Cl. ..... 5/450; 5/451

[58] Field of Search ..... 5/450, 451, 452, 422, 5/449

[56] References Cited

U.S. PATENT DOCUMENTS

| | | | |
|---|---|---|---|
| 4,462,128 | 7/1984 | LaBianco | 5/450 |
| 4,496,623 | 1/1985 | Fraige | 5/450 |
| 4,575,885 | 3/1986 | Hall | 5/451 |
| 4,672,701 | 6/1987 | Kocsis | 5/451 |
| 4,864,670 | 9/1989 | Woll et al. | 5/451 |

*Primary Examiner*—Alexander Grosz

*Attorney, Agent, or Firm*—Kinzer, Plyer, Dorn, McEachran & Jambor

[57] ABSTRACT

A water mattress has an outer shell and a wave dampening fiber baffle positioned within the shell. The baffle includes an upper comfort layer formed of a porous mass of bound-together fibers and a lower support layer formed of a porous mass of bound-together fibers. The fiber layers are separated by a wave barrier which is generally coextensive with both the upper and lower layers. The denier characteristic of the fibers in the upper comfort layer is no greater than half the denier characteristic of the fibers in the lower support layer.

10 Claims, 1 Drawing Sheet

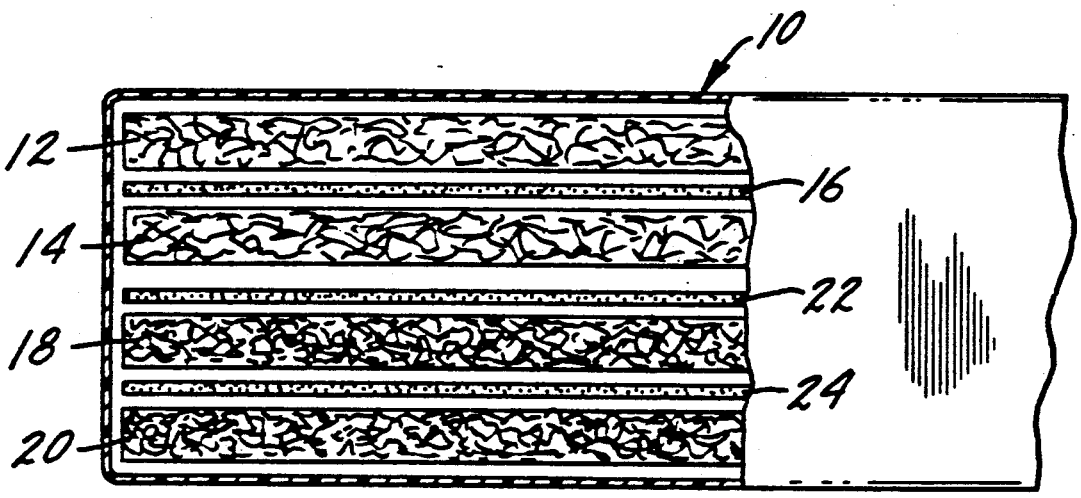
10
12
14
18
20
16
22
24

WATER MATTRESS WITH DUAL DENIER FIBER BAFFLE

THE FIELD OF THE INVENTION

This invention relates to water mattresses and in particular to the fiber baffles used in water mattresses to dampen wave action. More specifically, the invention relates to a fiber baffle having several fiber layers divided into support layers and comfort layers, with the comfort layers having fibers with a denier characteristic no greater than half the denier characteristic of the fibers in the support layers. The layers are each separated by a wave barrier which may be a layer of either foam polypropylene or foam polyethylene.

DESCRIPTION OF THE RELATED ART

There are numerous patents which disclose various types of wave dampening fiber baffles for use in water mattresses. The following U.S. patents, all owned by the assignee of the present application, are typical of such disclosures: U.S. Pat. Nos. 4,575,885, 4,517,691, 4,467,485 and 4,399,575.

SUMMARY OF THE INVENTION

The present invention relates to wave dampening fiber baffles for water mattresses and in particular to such a fiber baffle having fiber layers formed of fibers with differing denier characteristics.

A primary purpose of the invention is a wave dampening fiber baffle for a water mattress having an upper comfort layer and a lower support layer with the denier characteristic of the fibers in the comfort layer being no greater than half the denier characteristic of the fibers in the comfort layer.

Another purpose is a wave dampening fiber baffle of the type described in which each of the fiber layers are separated by a wave barrier which is generally coextensive with the fiber layers.

Another purpose is a fiber baffle as described in which there may be a plurality of comfort layers and a plurality of support layers with each of the layers being separated by a polypropylene or polyethylene wave barrier.

Other purposes will appear in the ensuing specification, drawing and claims.

BRIEF DESCRIPTION OF THE DRAWING

The invention is illustrated diagrammatically in the attached partial cross section of a water mattress with the improved fiber baffle disclosed herein.

DESCRIPTION OF THE PREFERRED EMBODIMENT

It has long been known in the water mattress art to use a porous mass of bound-together fibers as a wave dampening barrier. The above-referenced U.S. patents are typical of such constructions. The present invention provides a wave dampening structure which not only performs the desired wave dampening function, but also provides fibers of different denier characteristics with the layers of low denier fiber at the top supplying a comfortable sleeping surface, and the fibers having a higher denier characteristic at the bottom, bringing stiffness to the baffle.

In the drawing, the outer shell of the water mattress is indicated at 10 and the shell, as conventional, may be formed of polyvinylchloride or "vinyl," as it is commonly known.

Positioned within the outer shell 10 is an- upper layer 12 formed of a porous mass of bound-together fibers having a specific denier characteristic. There is a second layer 14 of fibers which may have the same or a slightly variant denier characteristic from the fibers in the layer 12. The layers 12 and 14 are separated by a foam wave barrier which is preferably polypropylene, but may be polyethylene. The wave barrier is indicated at 16.

Beneath the upper comfort fiber layers 12 and 14 are lower support layers of a porous mass of bound-together fibers indicated at 18 and 20. The denier characteristic of the fibers in the layers 18 and 20 may be the same or it may be slightly different, but, in any event, will be substantially different from the denier characteristic of the fibers in the comfort layers 12 and 14. Layers 14 and 18 are separated by a foam polypropylene wave barrier 22 and support layers 18 and 20 may also be separated by a wave barrier 24 which may be polypropylene or polyethylene foam.

It is preferred that each of the layers be separated by a wave barrier. The preferred material is a polypropylene foam, although a polyethylene foam may be equally satisfactory.

It is preferred that the denier characteristic of the fibers in the comfort layers be no greater than half of the denier characteristic of the fibers in the support layers. It is more specifically preferred that the difference in denier characteristic be greater than the described 50 percent. A specific example is to use fibers having a 32-denier characteristic for the one or more comfort layers and fibers having a 200-denier characteristic for the one or more support layers. Another example is to use fibers having a 50-denier characteristic for the comfort layers and fibers having a 100-denier characteristic for the support layers.

It is preferred that when there is more than one comfort layer of fibers and more than one support layer of fibers that the denier characteristics be the same or at least similar. What is desired is to provide a soft upper plushy comfort layer and a lower, somewhat stiffer support layer.

The wave barriers which may be of polypropylene or polyethylene foam reduce the height of a wave within the mattress brought about by a person sitting or lying on the mattress. For example, with a single wave barrier the wave height is reduced by one half. With two wave barriers the height of the wave is reduced by a third and following.

Whereas the preferred form of the invention has been shown and described herein, it should be realized that there may be many modifications, substitutions and alterations thereto.

The embodiments of the invention in which an exclusive property or privilege is claimed are defined as follows:

1. A water mattress including an outer shell and a wave dampening baffle positioned therein, said baffle including an upper comfort layer formed of a porous mass of bound-together fibers and a lower support layer formed of a porous mass of bound-together fibers, the upper comfort layer being formed of fibers that have a denier characteristic no greater than half the denier characteristic of the fibers of the lower support layer, said layers being separated by a wave barrier which is generally coextensive with said upper and lower layers.

2. The water mattress of claim 1 further characterized by and including a plurality of upper comfort layers each formed of a porous mass of bound-together fibers, each of said layers being separated by a wave barrier which is generally coextensive with the fiber layers.

3. The water mattress of claim 2 further characterized in that each of said comfort layers are formed of fibers having substantially the same denier characteristic.

4. The water mattress of claim 1 further characterized by and including a plurality of support layers each formed of a porous mass of bound-together fibers, each of said layers being separated by a wave barrier which is generally coextensive with the fiber layers.

5. The water mattress of claim 4 further characterized in that the fibers in each support layer have substantially the same denier characteristic.

6. The water mattress of claim 1 further characterized in that there are a plurality of upper comfort layers each formed of a porous mass of bound-together fibers and a plurality of lower support layers each formed of a porous mass of bound-together fibers, each of said layers being separated by a wave barrier which is generally coextensive with the fiber layers.

7. The water mattress of claim 6 further characterized in that each of the fibers in the comfort layers has substantially the same denier characteristic and each of the fibers in the support layers has substantially the same denier characteristic.

8. The water mattress of claim 1 further characterized in that the wave barrier is a sheet of foam polypropylene.

9. The water mattress of claim 1 further characterized in that the wave barrier is a sheet of foam polyethylene.

10. The water mattress of claim 1 further characterized in that the fibers in the comfort layer have a 32-denier characteristic and the fibers in the support layer have a 200-denier characteristic.

* * * * *